US007329184B2

(12) United States Patent
Yoshioka

(10) Patent No.: US 7,329,184 B2
(45) Date of Patent: Feb. 12, 2008

(54) GAME MACHINE

(75) Inventor: Keiri Yoshioka, Tokyo (JP)

(73) Assignee: Konami Gaming, Inc., Las Vegas, NV (US)

( * ) Notice: Subject to any disclaimer, the term of this patent is extended or adjusted under 35 U.S.C. 154(b) by 895 days.

(21) Appl. No.: 10/642,648

(22) Filed: Aug. 19, 2003

(65) Prior Publication Data

US 2004/0048655 A1 Mar. 11, 2004

(30) Foreign Application Priority Data

Sep. 9, 2002 (JP) ..... P2002-262761

(51) Int. Cl.
*A63F 9/22* (2006.01)

(52) U.S. Cl. ..... 463/23

(58) Field of Classification Search ..... 463/12–13, 463/23; 273/292

See application file for complete search history.

(56) References Cited

U.S. PATENT DOCUMENTS

| | | | | |
|---|---|---|---|---|
| 4,171,135 | A * | 10/1979 | Doyle et al. | 273/237 |
| 5,971,850 | A | 10/1999 | Liverance | |
| 6,364,764 | B1 * | 4/2002 | Suzuki | 463/7 |
| 6,739,973 | B1 | 5/2004 | Lucchesi et al. | |
| 2003/0064770 | A1 * | 4/2003 | Kaminkow et al. | 463/16 |
| 2005/0181861 | A1 * | 8/2005 | Kodachi | 463/20 |

FOREIGN PATENT DOCUMENTS

| | | | |
|---|---|---|---|
| JP | 11-76615 | A | 3/1999 |
| JP | 11-327552 | A | 11/1999 |
| JP | 2000-93656 | A | 4/2000 |
| JP | 2000-237457 | A | 9/2000 |
| JP | 2002-18121 | A | 1/2002 |
| JP | 2002-239248 | A | 8/2002 |
| WO | WO 97/14088 | A1 | 4/1997 |

OTHER PUBLICATIONS

Computer translation of JP 2002-018121, Jan. 22, 2002, 5 pages.*

* cited by examiner

*Primary Examiner*—Xuan M. Thai
*Assistant Examiner*—Alex F. R. P. Rada, II
(74) *Attorney, Agent, or Firm*—Masuvalley & Partners

(57) ABSTRACT

A game machine includes, an operating portion, a signal detector, a prompter, a determination receiver and a speed changer. The operating portion outputs a signal in accordance with a player's operation for proceeding a game. The signal detector detects either a consecutive signal within a predetermined period of time or an intermittent signal within a predetermined period of time from the operating portion. The prompter prompts a player to determine whether to change a speed of progress in the game when either the consecutive signal or the intermittent signal is detected. The determination receiver receives a player's determination regarding the change of the speed of progress in the game. The speed changer changes the speed of progress in the game in accordance with the player's determination when the player's determination is received.

2 Claims, 7 Drawing Sheets

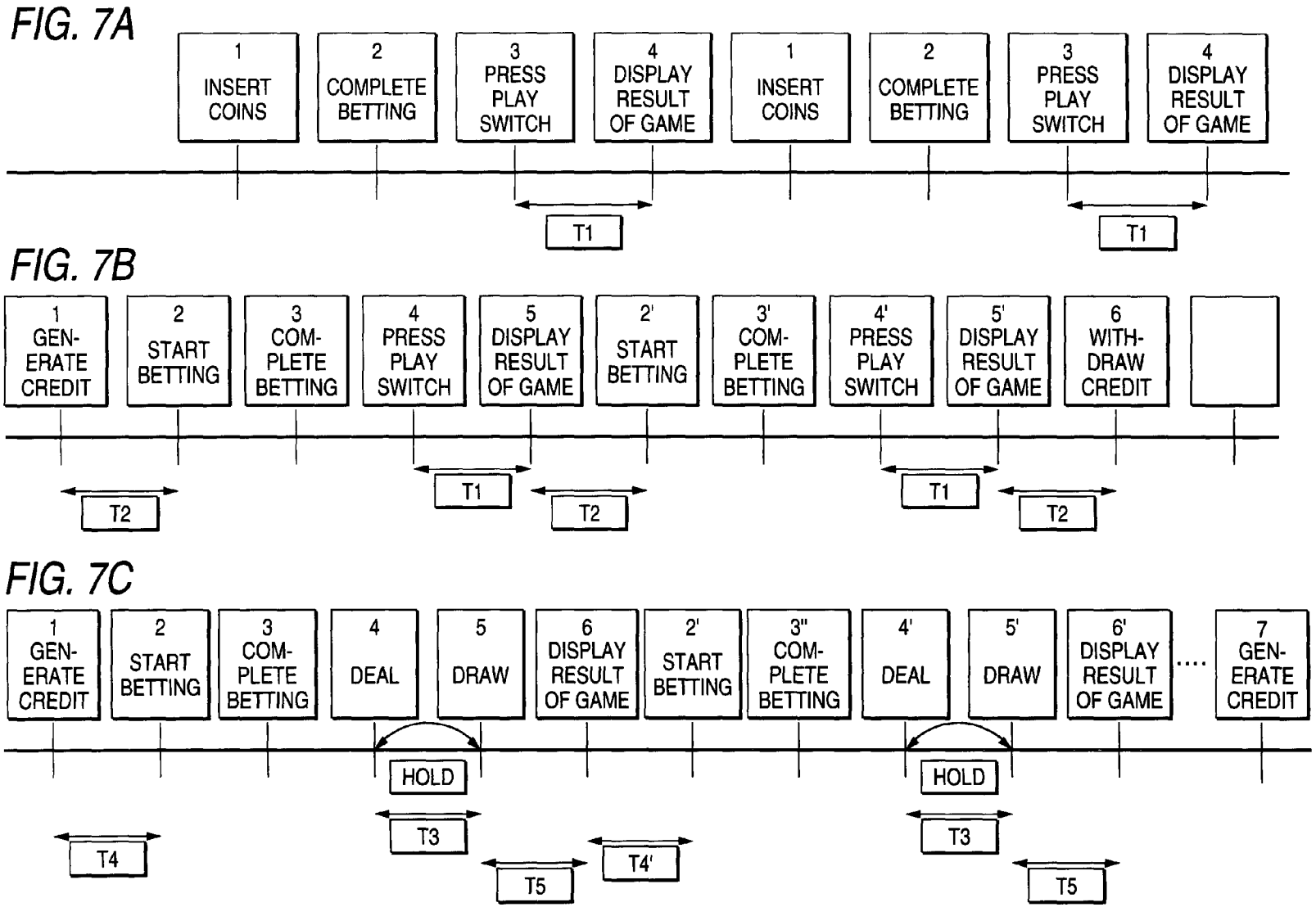
FIG. 7A
1 INSERT COINS
2 COMPLETE BETTING
3 PRESS PLAY SWITCH
4 DISPLAY RESULT OF GAME
1 INSERT COINS
2 COMPLETE BETTING
3 PRESS PLAY SWITCH
4 DISPLAY RESULT OF GAME
T1
T1
FIG. 7B
1 GEN-ERATE CREDIT
2 START BETTING
3 COM-PLETE BETTING
4 PRESS PLAY SWITCH
5 DISPLAY RESULT OF GAME
2' START BETTING
3' COM-PLETE BETTING
4' PRESS PLAY SWITCH
5' DISPLAY RESULT OF GAME
6 WITH-DRAW CREDIT
T2
T1
T2
T1
T2
FIG. 7C
1 GEN-ERATE CREDIT
2 START BETTING
3 COM-PLETE BETTING
4 DEAL
5 DRAW
6 DISPLAY RESULT OF GAME
2' START BETTING
3" COM-PLETE BETTING
4' DEAL
5' DRAW
6' DISPLAY RESULT OF GAME
7 GEN-ERATE CREDIT
HOLD
HOLD
T4
T3
T5
T3
T4'
T5

GAME MACHINE

BACKGROUND OF THE INVENTION

The invention relates to a game machine typified by a video game machine, such as a slot machine or a poker game machine, and more particularly, to a commercial game machine capable of changing the speed of progress of a game (hereinafter called "progress speed of a game").

In the field of a game machine such as a slot machine or a poker game machine, particularly, a commercial game machine, the game machine has a function for changing the progress speed of a game of the game machine, the function is implemented by (1) switching of a dip switch, (2) changing of a setting program to be performed by an operator, or (3) an automatic learning function of the game machine.

The switching of the dipswitch (1) is embodied in such a manner as shown in FIG. 8; specifically, upon receiving a request for changing the progress speed of the game, the operator changes the progress speed of the game by switching a dip switch 10*f* provided on a board 10 of the game machine.

The changing of the setting program (2) is embodied in such a way that the operator who has received a request for changing the progress speed of the game changes the progress speed of the game, by changing the setting program of the game machine so as to change the progress speed of the game.

The automatic learning function (3) is embodied such that a game machine performs automatic learning operation according to a player's speed of operating buttons, thereby changing the progress speed of the game.

However, the switching of the dipswitch (1) and the changing of the setting program (2) involve a necessity for switching a dip switch and changing a setting program. In order to render the switching and the change valid, power to the game machine must be turned on or off. To this end, a game in progress must be temporarily terminated. In addition, these operations are to be performed by the operator who serves as an administrator of the game machine. Therefore, the player must call the operator for changing only the progress speed of a game, which is burdensome to the player.

The automatic learning function (3) does not require any involvement of the operator. However, the progress speed of the game is changed on the basis of only a decision made by the game machine. The player feels as if being manipulated by the machine or pursued by the machine, satisfaction of the player's intent results in failure.

In addition, a configuration for changing the progress speed of the game by a specific operation performed the player is also conceivable. In such a case, the player must memorize the operation. Further, the progress speed of the game is not changed to a speed appropriate for the player, but is changed on the basis of only the player's determination. Therefore, a desirable progress speed of the game is not necessarily achieved.

Thus, in the related game machine, particularly a commercial game machine, it is not set from the view point of a player directly changing the progress speed of the game. Further, no consideration is given to a change in the progress speed of a game, by inferring the speed of progress suitable for the player or the player's psychological state.

SUMMARY OF THE INVENTION

It is therefore an object of the present invention to provide a game machine which can ascertain a player's indirect request for changing the progress speed of the game and which enables the player to directly involve in changing of the progress speed of the game.

In order to achieve the above object, when a signal output from an operating portion (e.g., a play button, a start button, or the like) is detected a plurality of times or for a long period of time, the game machine perceives the input signal as a player's request for changing the speed of progress in a game, thereby effecting a shift to a state in which a player can selectively input the speed of progress in a game.

More specifically, the invention provides the following.

(1) A game machine, comprising:

an operating portion, which outputs a signal in accordance with a player's operation for proceeding a game;

a signal detector, which detects either a consecutive signal within a predetermined period of time or an intermittent signal within a predetermined period of time from the operating portion;

a prompter, which prompts a player to determine whether to change a speed of progress in the game when either the consecutive signal or the intermittent signal is detected;

a determination receiver, which receives a player's determination regarding the change of the speed of progress in the game; and a speed changer, which changes the speed of progress in the game in accordance with the player's determination when the player's determination is received.

According to the configuration, when the player intermittently presses the operating portion, such as an operation button, a plurality of times in such a way that the operating portion is restored, a corresponding signal is output from the operating portion intermittently. The game machine detects the intermittent signal within the predetermined period of time, thereby allowing the player to determine whether to change the speed of progress in the game. When the player continuously presses the operating portion; that is, maintains a pressed state of the operating portion, the operating portion produces a corresponding continuous signal. The game machine detects the continuous signal within a predetermined period of time, thereby allowing the player to determine whether to change the speed of progress in the game. In other words, the game machine can perceive the intermittent signal or a consecutive signal from the operating portion as a player's request or desire to change the speed of progress in the game. Therefore, the player can set a desired speed of progress of the game.

Here, the word "operating portion for proceeding a game" signifies a cross-shaped key to be used for moving an object vertically and horizontally or a determination button to be used for determining an object or causing an object to run. Specifically, the invention is aimed at changing the speed of progress in a game. Hence, a command select button, or a like button, which is provided in a related art home game machine and can be immediately switched to a function for prompting the player to change the speed of progress in a game, is omitted. In other words, a player who desires a change in the speed of progress in a game has hitherto pressed a command select button or the like in order to directly input the desire. However, according to the invention, the player actuates the "operating portion regarding in progress of a game" other than the command select button or the like, the operating portion directly controlling the speed of progress in a game, thereby indirectly expressing the player's desire to change the speed of progress in a game. The player indirectly expresses a desire to change the speed of progress in a game.

Further, the word "intermittent signal" is a result of indirect expression of a desires to change the speed of progress in a game. Specifically, when the player desires to play a maximum number of games within a limited period of time, the player sometimes presses the "operating portion for proceeding a game" two or three times, unconsciously or with an irritated feeling. A desire to change the speed of progress in a game is detected by detection of such an unwanted operation signal. Input operation of the "operating portion for proceeding a game" is enabled in accordance with the result of detection, thus providing the player with a chance of controlling the speed of progress in a game.

The word "continuous signal" is a result of indirect expression of a desire to change the speed of progress in a game. Specifically, when the player desires to play a maximum number of games within a limited period of time, the player sometimes presses the "operating portion for proceeding a game" unconsciously or with an irritated feeling, for a long period of time (or strongly). A desire to change the speed of progress in a game is detected by detection of such an unwanted operation signal. Input operation of the "operating portion for proceeding a game" is enabled in accordance with the result of detection, thus providing the player with a chance of controlling the speed of progress in a game.

The player who considers the speed of progress in a current game too fast sometimes presses the "operating portion for proceeding a game" for a long period of time. In this case, there can be provided a chance of changing the speed of progress in a game.

In this way, the above configuration provides a game machine, wherein the psychological state of the player; that is, the indirect request issued by the player, is surmised, thereby enabling the player to change the speed of progress in a game, and wherein a change in the speed of progress of a game is finally left to the player's determination. Further, the speed of progress in a game can be readily changed by actuation of the operating portion for proceeding a game, and hence a game machine having superior operability can be provided.

In the above configuration, the consecutive signal from the operating portion over a predetermined period of time or intermittent output of a signal from the operating portion within a predetermined period of time is detected. Consequently, setting of a predetermined duration assigned to the type, nature, and scene of a game enables the game machine to surmise whether or not the player truly desires to change the speed of progress in a game, or whether or not the player desires to change the speed of progress in a game because a current game mode originally involves an increase in speed of progress of the game.

(2) Preferably, the game machine further comprises a prompt controller, which controls the prompter so as to prompt the player to determine whether to change the speed of progress in the game after the current game is completed, when either the consecutive signal or the intermittent signal output from the operating portion is detected during the game is proceeded.

In the above configuration, a timing at which the speed of progress in a game is to be changed is not set immediately in response to a request for changing the speed of progress in a game. Rather, the game machine is set such that the request is held in a standby condition until an interval between the current game and the next game arises, whereby the game in progress is completed at a speed employed thus far. Accordingly, the game in progress is not interrupted, thereby preventing disruption of the player's concentration on the game.

There may arise a case where the player's momentary faulty operation or the player's accidental operation results in "intermittent or consecutive signal from the operating portion." If "intermittent or consecutive signal from the operating portion" stemming from such a momentary faulty operation or accidental operation is taken as an "indirect expression of a desire for a change in the speed of progress in a game," a mismatch may arise between the player's request and the response of the game machine. However, in the above configuration, the game machine does not respond to the request for change before the game in progress is completed. Hence, the player's enthusiasm for playing the game is not weakened.

(3) Preferably, the game machine further comprises a prompt controller, which controls the prompter so as to prompt the player to determine whether to change the speed of progress in the game after the current game is suspended, when either the intermittent signal or the consecutive signal output from the operating portion is detected during the game is proceeded.

In the above configuration, in a game machine which perceives "intermittent or consecutive signal from the operating portion" as an "indirect expression of a desire for a change in the speed of progress in a game," a timing at which the speed of progress in a game is to be changed is set such that a game is temporarily and immediately brought into a paused state when a request for changing the speed of progress in a game is issued. Hence, the game machine can immediately respond to the player's request.

Particularly, when "intermittent or consecutive signal from the operating portion" arises frequently, it is assumed that the player strongly desires to change the speed of progress in a game. Therefore, in such a case, the output is detected, to thereby prompt the player to determine whether to change the speed of progress in a game by bringing the game in progress into a pending state. Thus, the game machine can immediately respond to the player's request.

(4) Preferably, the game machine further comprises a restorer, which restores the speed of progress in the game changed in accordance with the player's determination to an initial speed of progress of the game, when a restore signal from a restore signal generator after completion of the game is received.

Here, "a restore signal output from a restore signal generator" means that a case where the player has entered a determination to terminate the game by way of the operating portion is excluded. Specifically, when the game machine is equipped with an internal clock and a signal is generated after lapse of a predetermined period of time since the game was completed, the game machine is provided with a system configuration so that the game machine (or the data system) can perceive switching of the player. For instance, in a conceivable case, when a command is issued from the system, the game machine detects that the player has performed payout (settlement) operation, thereby outputting a signal.

Throughout the specification, the term "intermittent" means a state where, within a predetermined period of time, an interval between a first input operation and a second input operation is short. More specifically, the interval assumes a value of about 200 msec. or thereabouts. As a matter of course, when the speed of progress in a game is changed from an ordinary state, the interval is naturally varied. An "intermittent" interval is determined in consideration of a comparison between the current speed of progress in a game and a player's operation speed. The time required for an ordinary player to perform switching operation chiefly are concentrated to a range from 5 to 50 msec. or thereabouts. Further, an ordinary player performs about five intermittent pressing actions per second.

Here, the word "consecutive" means a state in which the player intentionally keeps pressing a switch. Specifically, the term "consecutive" implies a period of about two seconds. Here, the maximum pressing time corresponds to a period of time which will lapse until the end of one game; that is, a time which will lapse until, e.g., all the reels of a slot machine come to a halt.

In relation to the description of the pressing operation, an operation may start (is determined) when a switch is pressed or when a finger holding the switch pressed is released from the switch.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 7A, 7B, and 7C are time frame charts for describing a timing at which a sub-routine program B is to be executed.

DETAILED DESCRIPTION OF THE PREFERRED EMBODIMENTS

A game machine according to an embodiment of the invention will be described hereinbelow by reference to the drawings.

[Hardware Configuration of a Game Machine]

Figure 1:
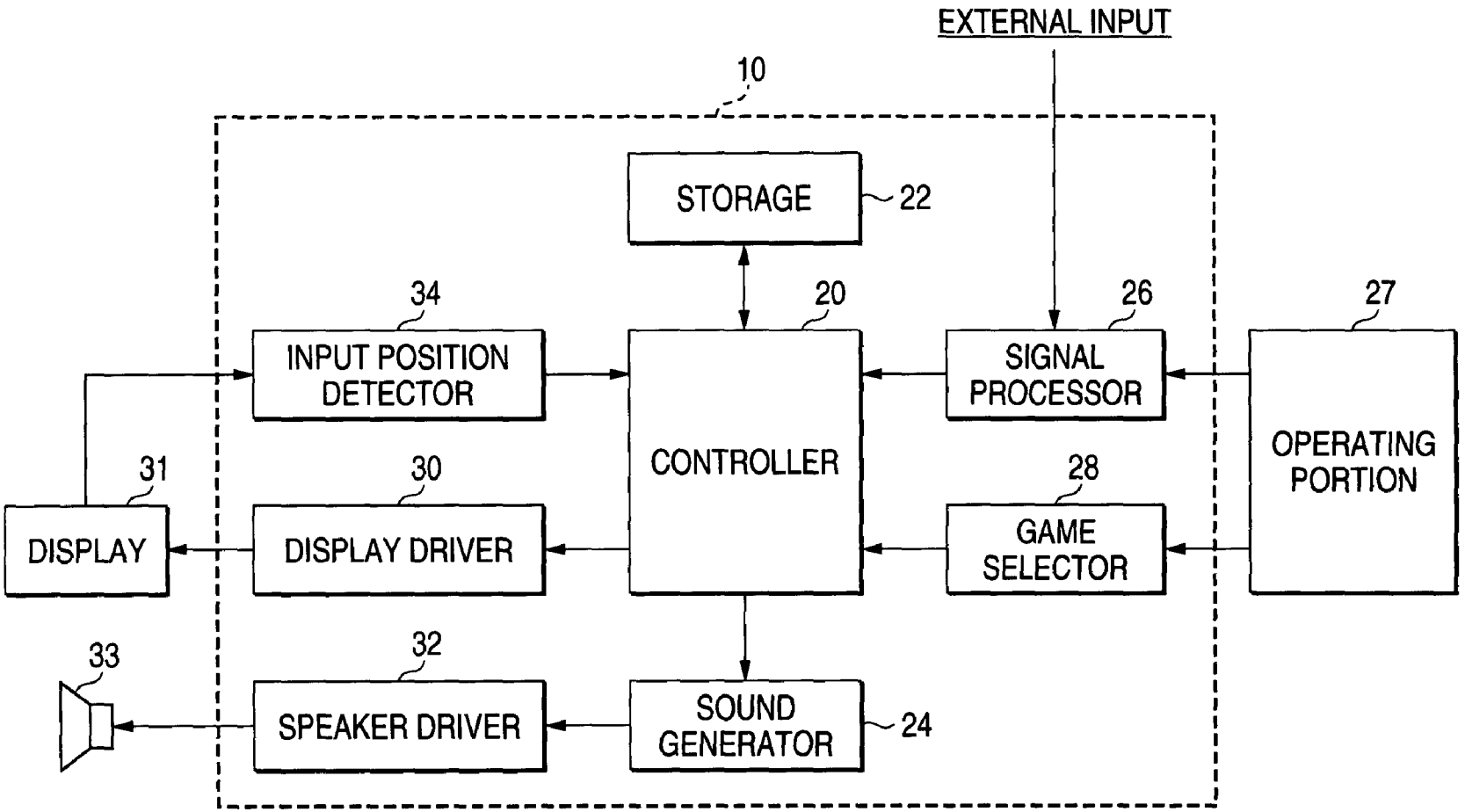
FIG. 1 is a block diagram showing a game machine according to an embodiment of the invention.

FIG. 1 is a block diagram of a control unit 10 of a game machine according to an embodiment of the invention. As shown in FIG. 1, the control unit 10 has a controller 20, a storage 22, a sound generator 24, a signal processor 26, a game selector 28, a display driver 30, a speaker driver 32, and an input position detector 34.

The controller 20 is constituted of an arithmetic processing circuit such as a CPU or a MPU. In accordance with a signal output from the signal processor 26 and that output from the game selector 28, the controller 20 communicates game data with the storage 22. The controller 20 produces and outputs a control signal to the display driver 30 and the sound generator 24.

The storage 22 is constituted of storage cells, such as RAM and ROM. The storage 22 stores a progress-state of a game via the controller 20, and stores game software, such as a poker game and a combination game.

The sound generator 24 produces sound or sound effects on the basis of a control signal output from the controller 20 and outputs a sound signal to the speaker driver 32. The speaker driver 32 drives a speaker 33 by amplifying the sound signal, and the speaker 33 outputs sound or sound effects.

The display driver 30 produces an image in accordance with the control signal output from the controller 20 and displays an image by outputting an image output signal to a display 31.

The signal processor 26 interprets a signal produced by an operating portion 27 installed in and connected to the control unit 10 and a signal produced by an external input device other than the control unit 10 and requests the controller 20 to execute the signal. The game selector 28 transmits, to the controller 20, a game which is selected from a game machine (e.g., a multi-game machine) having a plurality of types of games stored therein, by an operation entered by the player by way of the operating portion 27.

[Change in the Progress Speed of a Game]

A step of changing the progress speed of a game by the control unit 10 will now be described by reference to FIGS. 2 through 4B.

Figure 2:
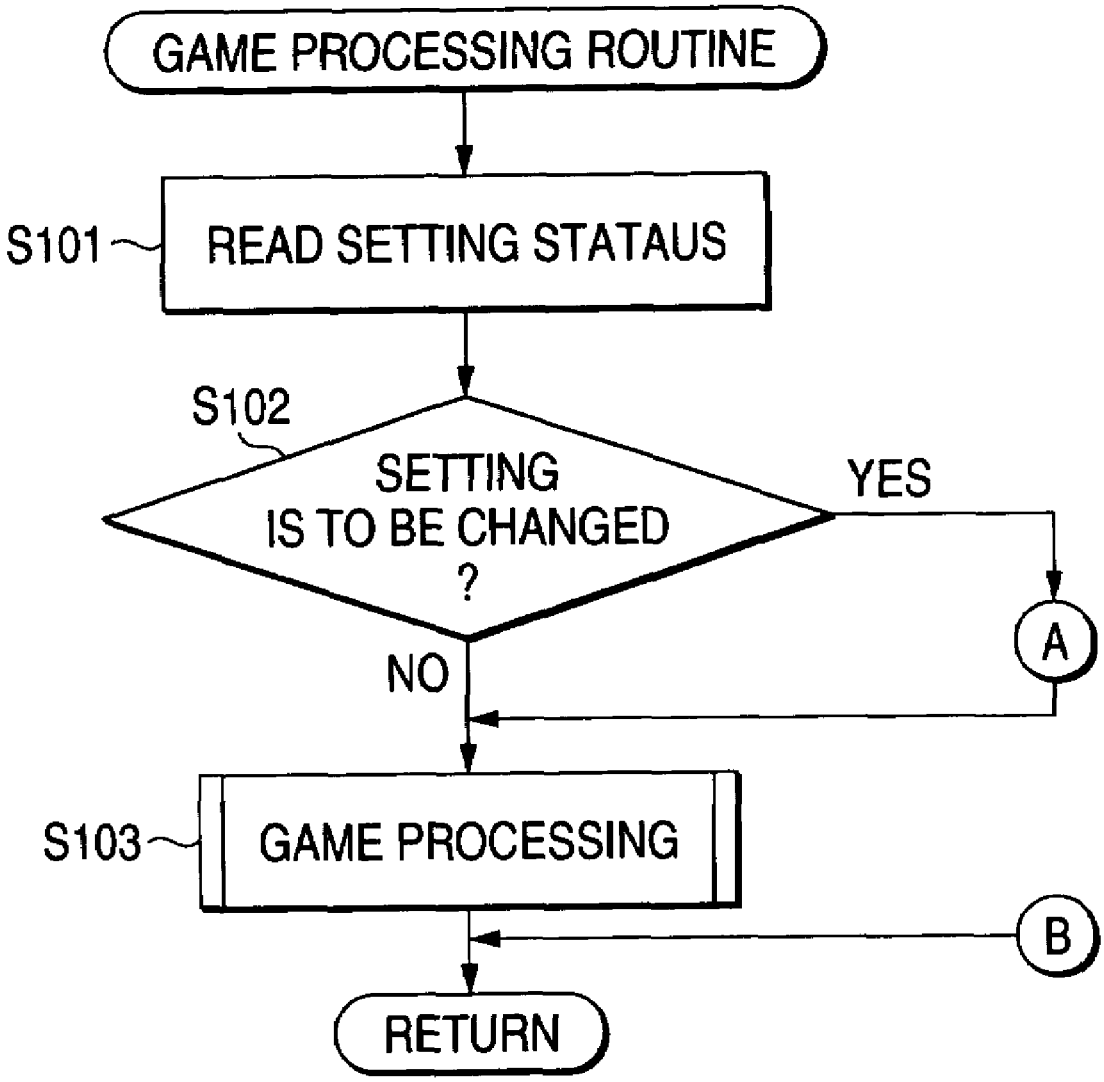
FIG. 2 is a flowchart showing a game processing routine of the game machine.
Figure 3:
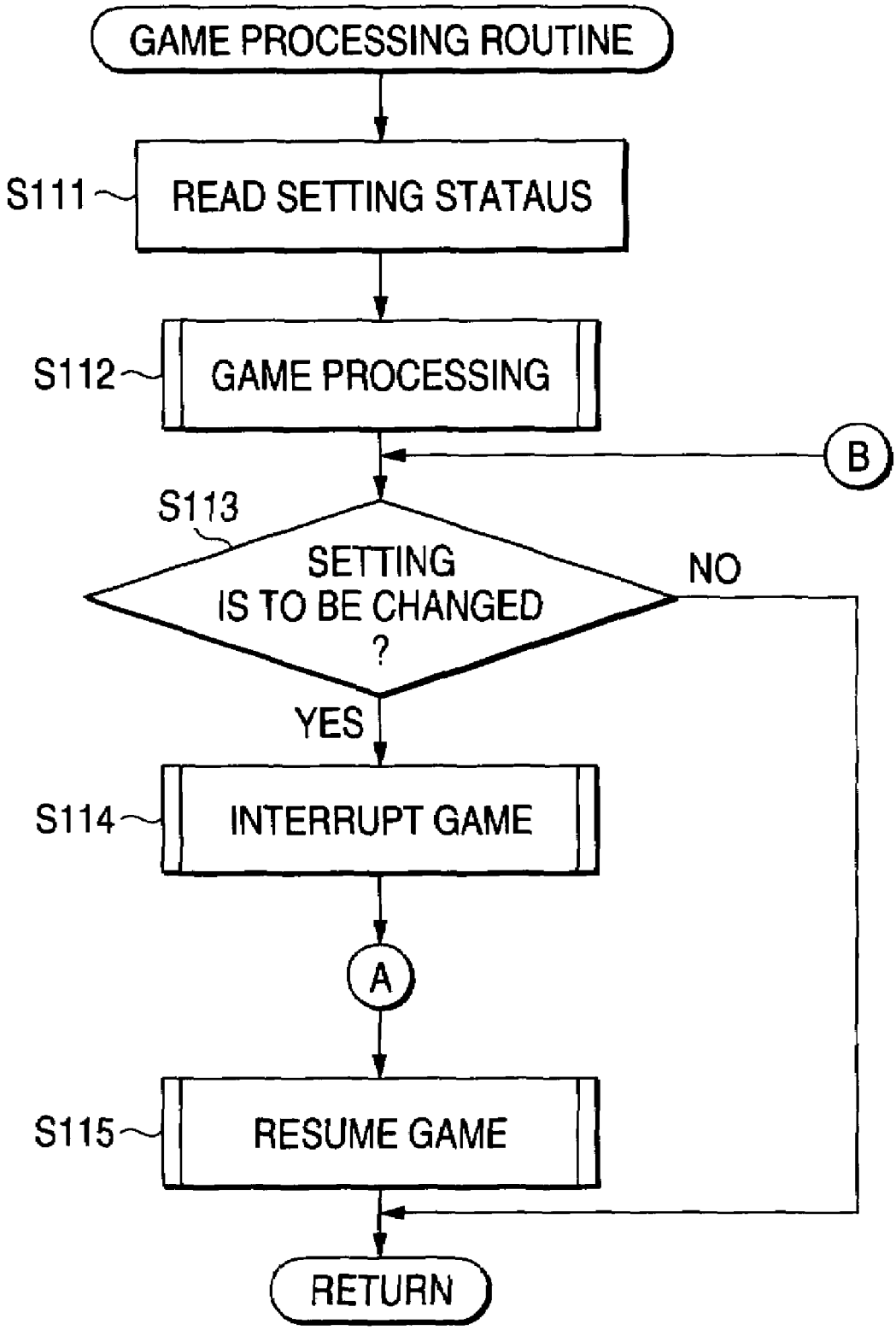
FIG. 3 is a flowchart showing the game processing routine of the game machine.
Figure 4A:
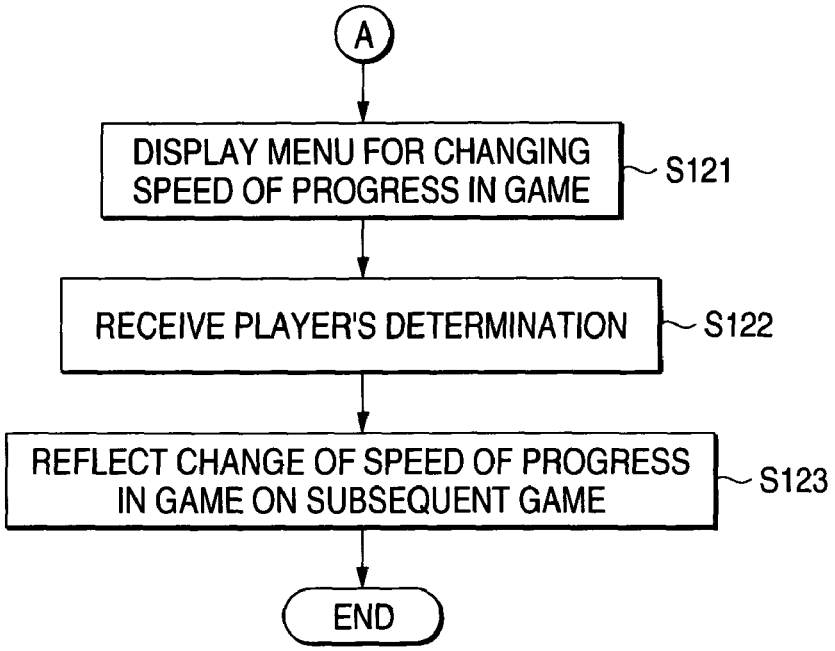
FIGS. 4A and 4B are flowcharts showing a game processing sub-routine of the game machine.
Figure 4B:
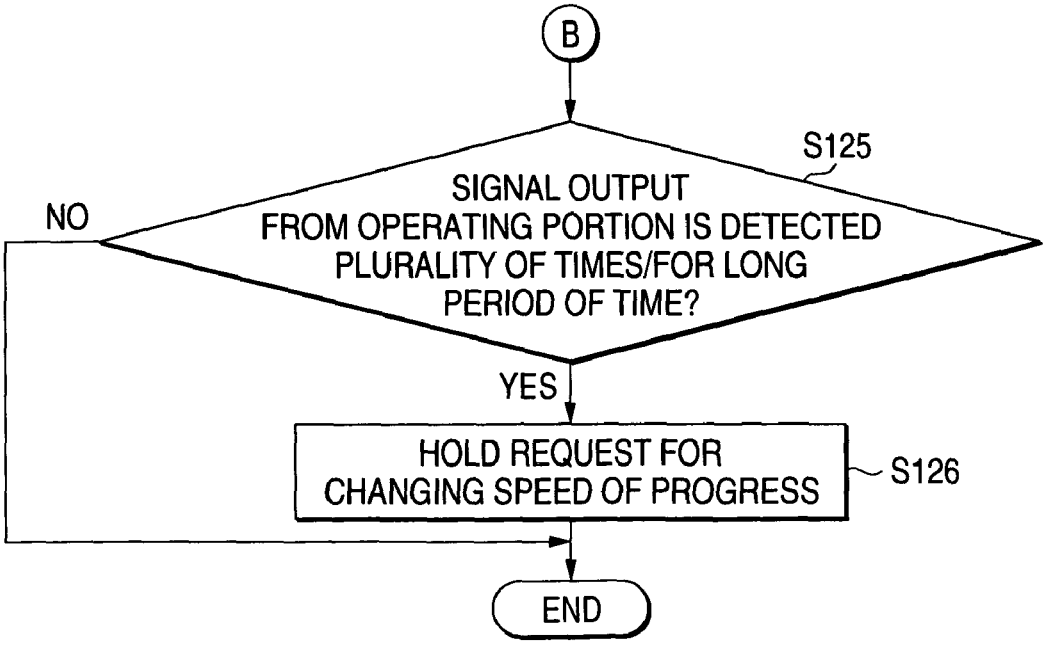

FIGS. 2 and 3 are flowcharts showing a game processing routine of the control unit 10. FIG. 2 shows a process for changing the progress speed of a game after progress of the game is completed, and FIG. 3 shows a process of changing the progress speed of a game while the game in progress is brought into a pending state. FIGS. 4A and 4B show sub-routines employed at the time of game processing by the control unit 10, wherein FIG. 4A shows a sub-routine for changing the progress speed of a game, and FIG. 4B shows a sub-routine for detecting origination of a signal from the operating portion.

By reference to FIG. 2, there will now be described an embodiment of the invention. In the embodiment, a timing, at which the progress speed of a game is changed, is not set immediately when a request for changing the progress speed of a game is issued. The request for change is held in a standby condition until an interval between the current game and the next game appears. The timing is set after the game in progress is completed at a speed employed thus far.

The player inputs the amount to be bet while using a game value (e.g., tokens, hard currencies, paper currency, coins, or some form of credit indicator, such as a credit card), whereupon a game is started and a setting status of a game machine is loaded (S101). More specifically, the game program stored in the storage 22 and the progress-status of the game employed thus far are loaded. When the game machine is restored to its initial setting state, an initial setting state is read from the storage 22.

A determination is made as to whether or not settings are changed (S102). Here, a case where settings are changed includes changing of a setting state for progress speed of a game. When it is determined that the settings are changed, a sub-routine program A is read.

When the setting for the progress speed of the game is changed or when in step S102 it is determined that the settings are not changed, game processing is performed (S103). By the game processing, the game proceeds under control of the controller 20.

During the course of the game processing, a sub-routine program B stays resident in the storage 22, and the sub-routine program B performs interruption at a predetermined opportunity. Specifically, when intermittent output of a signal or consecutive output of a signal from the operating portion is detected through the player's operation of the operating portion, the sub-routine program B is executed.

As shown in FIG. 4B, the sub-routine makes a determination as to whether or not a signal output from the operating portion is detected a plurality of times or a for a long period of time (S125). Here, detection of a signal a plurality of times signifies detection of intermittent output of a signal by an intermittent signal generation detection function. Further, detection of a signal for a long period of time signifies continuous detection of a signal by a continuous signal detection function. When it is determined that a signal is detected, it is deemed that a desire or request to change the progress of the game is issued, and the request for changing the progress speed is latched (S126). Specifically, a signal to be used for fulfilling the request for change is temporarily stored in the storage 22, whereby the signal remains in a standby condition until an interval appears between the current game and the next game. The game is completed at the speed that has been employed thus far.

A flag is set for the stored change request signal. The setting state is loaded at a initiation of the next game (S101). In step S102, it is determined that the setting is changed since the flag is set in the setting state.

Figure 6:
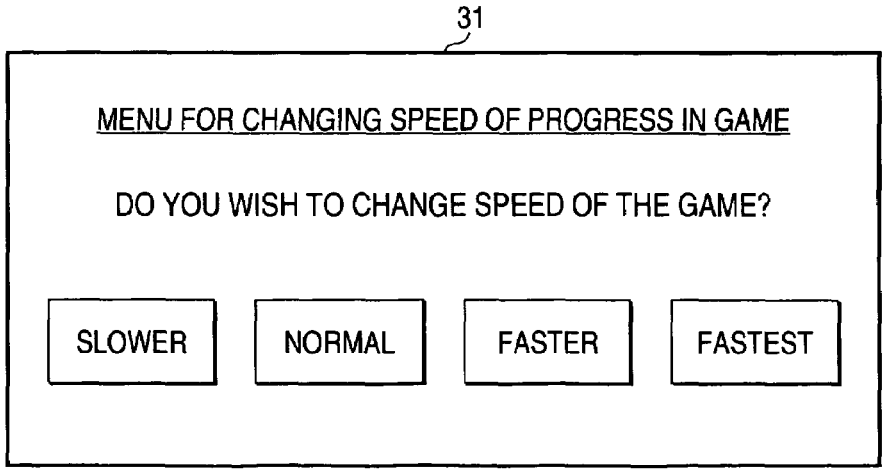
FIG. 6 is an example menu for changing the speed of progress in a game to be displayed on a display of the game machine according to the embodiment of the invention.
Figure 8:
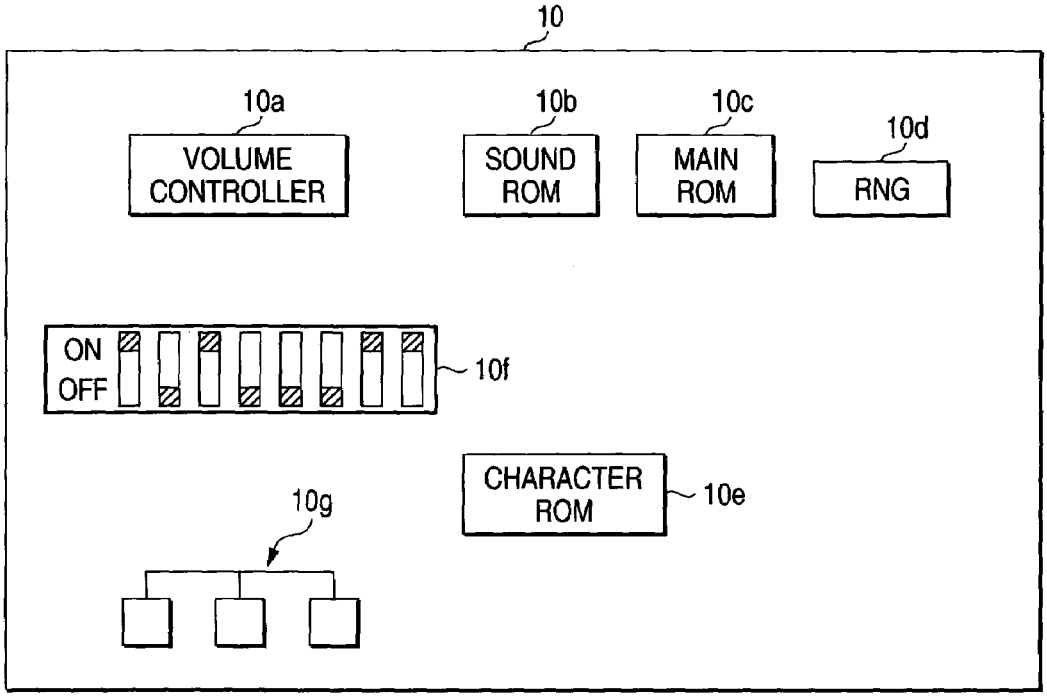
FIG. 8 is a view for describing a function for changing the speed of progress in the related game.

By reference to FIG. 4A, a sub-routine to be used for changing the progress speed of the game will now be described. First, a menu for changing the progress speed of a game is displayed on the display 31 (S121). The menu is displayed by reading image data stored in the storage 22 and displaying the read image data on the display 31 by way of the display driver 30. As shown in FIG. 6, a superimposed image reading "Do you wish to change the speed of the game?" is displayed on the display 31, thereby prompting the player to determine whether to change the progress speed of the game.

Here, the progress speed of the game displayed on the display 31 can be set at a plurality of settings, such as "Slower"—"Normal"—"Faster"—"Fastest." The signal processor 26 interprets the player's determination in accordance with a signal which corresponds to a step and is entered by way of the operating portion 27. The player's determination is transmitted to the controller 20 (S122).

A touch screen switch can also be adopted for receiving the player's determination. In this case, the player touches the image appeared on the display 31, whereby the input position detector 34 detects the touched position. The progress speed of the game corresponding to the position is received as the player's determination (S122).

The received player's determination is reflected on the progress of a subsequent game as a change to the progress speed of the game effected by the controller 20 (S123).

Processing for changing the progress speed of the game to be performed by the controller 20 will be described in detail by reference to FIG. 5.

Figure 5:
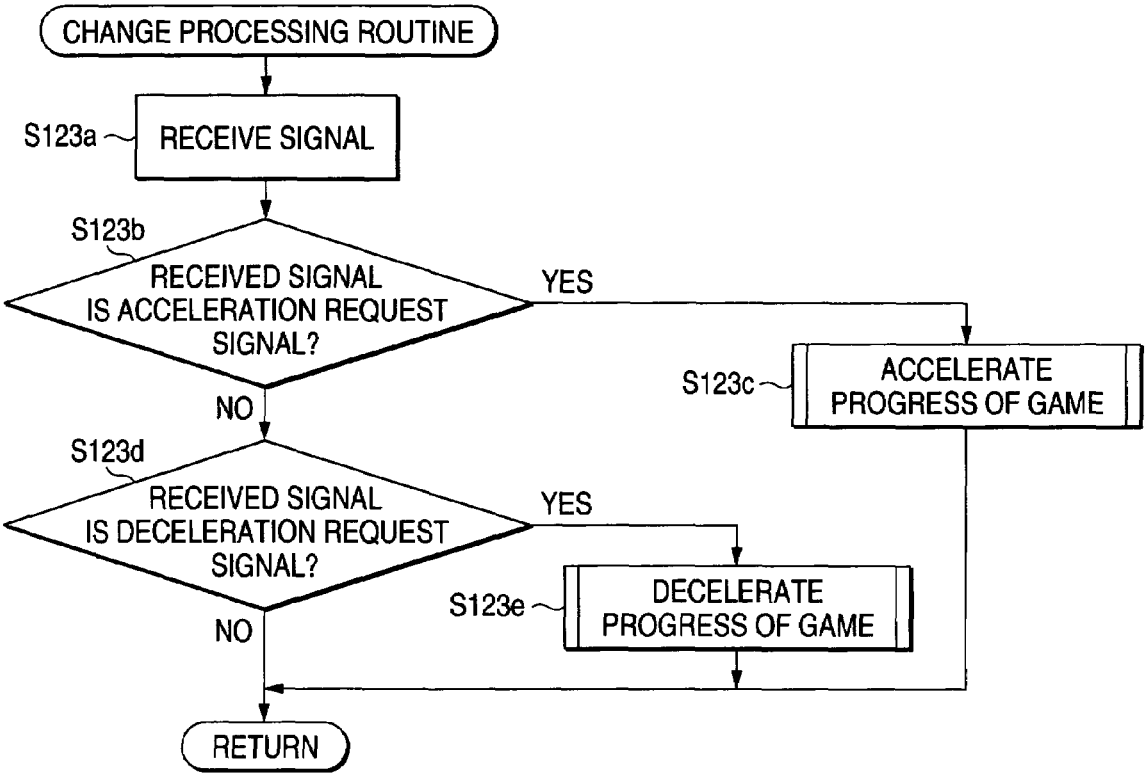
FIG. 5 is a flowchart showing a change processing routine to be performed by controller 20.

FIG. 5 is a flowchart showing a change processing routine to be performed by the controller 20.

First, the controller 20 receives a signal transmitted from the signal processor 26 (S123*a*). The controller 20 determines whether or not the signal is a signal for requesting acceleration of the progress speed of the game (S123*b*). If the signal is determined to be the acceleration request signal, the controller 20 performs progress acceleration processing (S123*c*), thereby reflecting a change in the progress speed of the game.

Here, the progress acceleration processing is processing for accurately accelerating the progress in accordance with a signal having information about the player's request for accelerating the progress of the game (S123*c*). For example, when steps of the game program stored in the storage 22 are loaded, programming is made such that delay processing in which a predetermined delay time is set is executed. When the controller 20 receives a signal having information regarding the player's progress acceleration request, interruption processing is performed so as to shorten the delay time in accordance with the level of requested acceleration.

For instance, a timer having a variable X is set between steps of the program, and the variable X is set to a default of 0.2 seconds. When the speed of the game is to be increased, interruption processing is performed for changing the variable to a value of 0.1 seconds.

In relation to a slot machine, interruption processing may be performed such that, when the controller 20 receives a signal having information regarding the player's request for increasing a progress speed in a step for reading video data from a video image table, the number of frames of video data to be read within a predetermined period of time is increased in accordance with the level of required acceleration.

For example, according to a method for changing the progress speed of a game, the number of frames to be read per second is set to a variable Y in the step of loading video data from the video image table. Here, Y is a default value of 16 frames. When the speed of the game is to be increased, interruption processing is performed for changing 16 frames to 24 frames.

Next, the controller 20 determines whether or not the signal transmitted from the signal processor 26 is a signal for requesting deceleration of the progress of the game (S123*d*). When the signal is determined to be a signal for requesting deceleration, the controller 20 performs progress deceleration processing (S123*e*), whereby the change is reflected on the progress speed of the game.

The progress deceleration processing is processing for accurately decelerating the progress in accordance with a signal having information regarding the player's request for decelerating the progress of the game (S123*e*). Specifically, the controller 20 performs the operation described in connection with the progress acceleration processing in reverse.

For instance, a timer having a variable X is set between steps of the program, and the variable X is set to a default of 0.2 seconds. When the speed of the game is to be decreased, interruption processing is performed for changing the variable to a value of 0.4 seconds.

In a step for reading the video data from the video image table, the number of frames to be read per second is set to the variable Y. The Y assumes a default value of 16 frames. However, when the progress of the game is to be made slow, interruption processing is performed for changing the number of frames to 12 frames.

According to the change processing routine, the controller 20 determines whether or not the signal is a signal for requesting acceleration. Either a determination as to whether or not the signal is for requesting acceleration or a determination as to whether or not the signal is for requesting deceleration may come first.

The progress speed of the game can also be changed as a result of an increment or decrement in the number of steps of a program to be processed during a predetermined period of time in accordance with operation of the operating portion.

In this way, a change in the progress speed of the game requested during the preceding game can be made before the next game starts.

By reference to FIG. 3, there will now be described an embodiment of the invention. In the embodiment, when a request for changing the progress speed of a game is issued, a timing, at which the progress speed of a game is to be changed, is set immediately by temporarily holding a game which has been played thus far. In connection with processing similar to that pertaining to the previously-described steps, repeated explanations thereof are omitted.

The player inputs the amount to be bet while using the game value, whereupon a game is started and a setting status of a game machine is loaded (S111).

Game processing is performed, and a game is caused to proceed under control of the controller 20 (S112).

When intermittent output of a signal or consecutive output of a signal from the operating portion is detected during the game processing, in step S125 of the sub-routine program B it is determined that the signal output a plurality of times or for a long period of time from the operating portion is detected. It is deemed that a desire or request for changing the progress speed of the game is made, and the request for changing the progress speed is stored (S126). Specifically, the signal for requesting change is temporarily stored in the storage 22.

The stored signal for requesting change sets a flag for changing settings. Hence, in step S113, when processing is returned to the game processing routine from the sub-routine program B, it is determined that the setting s are changed.

At this time, processing for interrupting the game is performed (S114). In order to temporarily bring the game into a paused state, the controller 20 produces a signal, whereupon the game status is temporarily stored in the storage 22.

After the game is brought into a paused state, the sub-routine program A is executed.

The player is prompted to determine whether to change the progress speed of the game (S121). The player's determination as to whether or not the progress speed of the game is to be changed is received (S122). The received player's determination is reflected on progress of a subsequent game (S123), and processing for resuming the game is performed (S115).

When it is determined that the signal output a plurality of times or for a long period of time from the operating portion is not detected in step S125 of the sub-routine program B, the sub-routine is terminated immediately. Further, since a flag to be used for changing the settings is not set, NO is selected in step S113, whereby the ordinary game processing is terminated.

In this way, when a request for changing the progress speed is issued during the course of the game, the progress speed of the game can be changed immediately by bringing the game in progress into a paused state.

The changed progress speed of the game is reflected on progress of a subsequent game so as to shorten the cycle of one game. Specifically, in the case of a poker game, a result of the game is quickly displayed by shortening the time required to turn up cards. In the case of a combination game, a result of the game is quickly displayed by shortening the time required to spin reels. In a case where the progress speed of the game is to be made slow, the changed progress speed is reflected on progress of a subsequent game such that the cycle of one game is made longer. Thus, the previously-described processing is performed in reverse.

[Execution of the Sub-Routine Program B]

Execution of the sub-routine program B shown in FIG. 4B; particularly, a time to execute the program, will now be described.

In the sub-routine, a flag indicating whether to change the progress speed of the game is set when the signal output a plurality of times or for a long period of time from the operating portion is detected. The sub-routine is executed within a predetermined period of time.

Here, the term "predetermined period of time" means a period during which the player receives a benefit by operating the operating portion. Accordingly, in the case of a game machine which is not a credit machine; i.e., the game machine which does not have any function of accepting paper money or a ticket, accepts only coins, and automatically pays out coins directly from a hopper instead of awarding credits (i.e., instead of coins being reserved) because of lack of a crediting function, when the game machine remains in a standby condition in which no coins are inserted, the user gains no benefit by operating the operating portion.

More specifically, in the case that the game machine is not a credit machine, when even one coin is inserted while the game machine remains in a standby condition, a bet is deemed to be laid, and a play switch becomes active. A game is started by a first operation of the play switch. The play switch remains effectively active until a result of the game is displayed. Meanwhile, when the play switch is pressed intermittently or continuously, the game machine detects intermittent or continuous generation of a signal from the operating portion, thereby bringing the game machine into a mode for setting a change in the speed of the game (hereinafter often called a "game speed changing mode").

More specifically, a duration T1 shown in FIG. 7A (between operations 3 and 4) from when the play switch is pressed until a result of the game is displayed is taken as a predetermined period of time. In other words, the predetermined period of time from the moment the play switch is pressed after completion of a betting operation until the moment a result of the final game is displayed serves as a time frame during which the game machine can enter the mode for changing the speed of a game.

The description is directed toward the game machine which does not have any credit function. However, the invention can also be applied to a game machine having a credit function. Accordingly, in relation to the game machine having the credit function, a duration from when the play switch shown in FIG. 7B is pressed until when a result of the game is displayed (i.e., the duration T1 between operations 4 and 5) serves as a predetermined period of time.

Game machines having a credit function include one in which additionally-inserted coins are added as credits to a credit meter and one in which all the inserted coins are temporarily added to the credit meter. The moment the player is afforded credits, the player is considered to have determined to play a plurality of games on that game machine. Therefore, the game machine is a private machine for the player who intends to play games on that machine for as long as the player possesses credits.

Such a credit machine involves a duration from the moment credits have arisen in the machine until the moment the credits become lost (called a "credit possessing period"); that is, a period of time during which the player can gain a profit by actuation of the operating portion. Namely, the game machine can enter the game speed changing mode during an interval between games to be played by the player without placing bets. In a case where credits become lost as a result of a bet on a game but a win is achieved as a result of the game, thereby adding new credits to the credit meter, the game machine can enter the game speed changing mode during an interval between games which are to be played without bets.

Consequently, in the case of the game machine having the credit function, the credit possessing period from when the credit shown in FIG. 7B arises until when the credit is lost (e.g., a period T2 existing between operations 1 and 2, between operations 5 and 2', and between operations 5' and 6), exclusive of a period from when a bet is started until when the bet is completed (the period existing between operations 2 and 3 and between operations 2' and 3'), is also taken as the predetermined period of time. More specifically, the game machine can enter the game speed changing mode even during a period from when coins are inserted until when a bet is started (i.e., the period T2 existing between the operations 1 and 2), a period from when a result of a game is displayed until another bet is started (i.e., the period T2 existing between the operations 5 and 2'), and a period from when a result of the game is displayed until when the credits are lost (i.e., the period T2 existing between the operations 5' and 6), wherein the player does not play any games while possessing credits.

Input of credits can be effected not only when the player inserts coins, but also when the player inserts paper money or tickets or through transfer of credit data or the like from the host computer. Further, the game machine may enable the player to switch between a mode for not using the credit function (i.e., a non-credit mode) and a mode for using the credit function (i.e., a credit mode).

The foregoing description presumes the case of a game machine having a play switch whose function is uniquely set; for example, a game machine in which a result of a slot machine game is determined immediately by actuation of the play switch. However, in the case of a game machine having a functionally-variable play switch, the machine has play steps called a DEAL step and a DRAW step for a poker game. In the case of a game in which two functions; that is, a DEAL function and a DRAW function, are performed through use of a single play switch, a predetermined period of time to be described below can also be set.

In the poker game, the player can play a game while placing a bet ranging from one coin to a maximum of five coins. Once the player places a bet of five coins, which is the maximum number of coins, the player cannot place any further bet of coins. Therefore, a game is automatically started even when the player does not push a DEAL switch. Subsequently, the player selects cards by use of a HOLD switch such that an advantageous game result is achieved, and a result of the game is displayed when the player presses the DRAW switch.

When the player presses the DRAW switch intermittently or continuously at this time, the game machine detects intermittent or consecutive output of a signal from the operating portion, whereupon the game machine can enter the game speed changing mode.

Specifically, a HOLD period (i.e., a period T3 existing between operations 4 and 5 and between operations 4' and 5') shown in FIG. 7C does not become a predetermined period. Rather, a duration from when the DRAW switch is pressed until a result of the game is displayed (a period T5 existing between operations 5 and 6 and between periods 5' and 6') is taken as a predetermined period.

A play in which the player places a bet, which is less than the maximum number of bets; that is, a bet of one coin to a bet of four coins, requires the player to lay a bet and press the DEAL switch. If the player presses the DEAL switch twice at this stage, the first pressing action is taken as an operation for activating the DEAL switch, and the second pressing action is an operation for activating the DRAW switch. Therefore, there may arise a problem in which the game ends without the player having a chance to hold cards despite the player's desire for entering the game speed changing mode.

Accordingly, in the case of a game involving play steps similar to those of a poker game, the following durations may be taken as predetermined periods of time; namely, a duration corresponding to the credit possessing period during which a game is not in progress; a duration from when cards are drawn until when a result of a game is displayed, except a period in which a game is in progress and a bet is to be placed and a period in which a holding operation is to be performed, i.e., a duration in which a bet has not yet been placed while credits are possessed; and a duration in which a game is in progress from when the function of the DRAW switch has become active until when a result of the game is displayed.

In short, a duration from when a credit is placed until when a bet is started (i.e., the period T4 existing between the operations 1 and 2) shown in FIG. 7C and an a duration from when a result of a game is displayed until when betting for the next game is started (i.e., a period T4' existing between operations 6 and 2') are taken as predetermined periods of time.

A duration during which a game is in progress from when a process for determining a final result of a game is started until when the process is completed can also be taken as a predetermined period of time. In other words, in the case of a poker game, a time frame during which the game can enter the game speed changing mode is invoked if the player intermittently or continuously presses the DRAW switch when the function of the DRAW switch becomes active.

A duration from when the DRAW switch shown in FIG. 7C is pressed until when a result of a game is displayed (i.e., a period T5 existing between operations 5 and 6 and between operations 5' and 6') is taken as a predetermined period of time.

In this way, a signal output from the operating portion may change according to the function of a pressed switch. Hence, intermittent or consecutive output of a signal from the operating portion within a predetermined period of time can be determined on the basis of the nature of the signal.

[Resetting of the Settings Regarding the Game Progress Speed]

There will now be described an embodiment of the invention; namely, a function of resetting the speed of progress of a game (a game progress speed) to its initial setting as a result of a change is made to the progress speed.

This function can be implemented by causing the controller 20 to reset settings through use of a signal other than that output from the operating portion of the game machine; e.g., a signal output from an internal timer of the control unit 10, such that initial settings are resumed after lapse of a predetermined period of time. Alternatively, a floor attendant uses a change in status, such as actuation of a key switch, as an external input other than the signal output from the operating portion, to thereby reset the progress speed of the game and restore the game machine to its initial settings.

Particularly, the previously-described non-credit machine automatically pays cash (i.e., performs settlement operation) every time a game is finished. If no subsequent game is played for a predetermined period of time (e.g., three minutes or more) and if the game machine remains in a standby condition without betting action, the settings are automatically reset, and the game machine is restored to its initial settings.

In the credit machine, the player's cue to end a game is realized by settlement of the credits. Hence, when no credits are inserted for the next game for a given period of time (e.g., three minutes) after the player is received a payout (i.e., after the player performs a settlement operation), the settings of the game machine are reset, and the game machine is restored to its initial settings. When no credit is stored in the game machine and the game machine remains in a standby condition without a bet for a given period of time, the settings pertaining to the progress speed of the game are reset.

When the player uses a player's card which is employed by a data system installed in an amusement place and which can specify a player, the player can be identified by use of the player card. If the player is switched to another player within three minutes, the game machine can identify the new player. Therefore, settings can be reset immediately by ascertaining switching of the player through use of the player card, thereby restoring the game machine to its initial settings. In this case, an identification signal assigned to the player card corresponds to a signal other than the signal output from the operating portion of the game machine.

When a plurality of game machines are interconnected and communicable by way of a data system and a slot tournament is held, all employed game machines must be set to the same progress speed. In this case, settings are reset immediately by a total reset command output from the data system, thereby enabling the game machine to restore its initial settings. Alternatively, such initial settings may be set for the speed of progress in a special game for a tournament.

When game machines disposed in an amusement facility are interconnected by way of the data system and when frequencies of players changing their game machines and the desired speed of game progress changes considerably from weekdays to weekends or holidays, settings can be reset immediately by causing the data system to output a total reset command, to thereby restore the game machines to their initial settings. Such initial settings may also be set as the speed of progress in a special game. Such a total reset command output from the data system corresponds to a signal other than the signal output from the operating portion of the game machine.

When a big win (Jackpot), for which a mechanical hopper cannot provide a total amount of payment, is achieved, the floor attendant provides, in cash or with a check, a total amount of payment or a remaining payment determined by subtraction of the amount of coins or tokens paid from the hopper from the total amount of the payment. When payout of the payment is completed in this case, the floor attendant resets the speed of progress in the game by use of an external input such as a key switch, thereby restoring the game machine to its initial settings. Here, the external input signal originating from the key switch or the like is a signal originating from a location other than the operating portion of the game machine.

It is assumed that a single multi-game machine stores a plurality of types of games, e.g., two types of video combination games and three types of video poker games, and the player can select one game by actuation of the operating portion 27. When the player selects another game, the game machine can be reset to its initial setting by resetting the speed of progress in the game.

Further, in relation to the types of coins acceptable for a game machine, denominations (types of money) assigned to a game machine are usually set. When the player changes a denomination while keeping credits, a machine which enables the player to select a plurality of types of money in a single game machine can be restored to its initial setting by resetting the speed of progress in the game.

The game machine of the embodiment is described by taking, as examples, game machines by means of which a combination game or a poker game is played. However, the invention is not limited to these game machines and can also be applied to all types of games, such as a bingo game.

What is claimed is:

1. A game machine, comprising:

an operating portion, which outputs a signal in accordance with a player's operation for proceeding a game;

a signal detector, which detects either a consecutive signal within a predetermined period of time or an intermittent signal within a predetermined period of time from the operating portion; a prompter, which prompts a player to determine whether to change a speed of progress in the game when either the consecutive signal or the intermittent signal is detected;

a determination receiver, which receives a player's determination regarding the change of the speed of progress in the game; and a speed changer, which changes the speed of progress in the game in accordance with the player's determination when the player's determination is received, a prompt controller, which controls the prompter so as to prompt the player to determine whether to change the speed of progress in the game after the current game is completed, when either the consecutive signal or the intermittent signal output from the operating portion is detected during the game is proceeded.

2. The game machine as set forth in claim 1, further comprising a restorer, which restores the speed of progress in the game changed in accordance with the player's determination to an initial speed of progress of the game, when a restore signal from a restore signal generator after completion of the game is received.

* * * * *